United States Patent [19]

Schlegel et al.

[11] 4,297,175

[45] Oct. 27, 1981

[54] PROCESS FOR PARTIALLY ELECTROPLATING FLAT SILVER

[75] Inventors: Hans Schlegel, Ulm; Theodor Nowotny, Geislingen, both of Fed. Rep. of Germany

[73] Assignee: Wurttembergische Metallwarenfabrik, Geislingen, Fed. Rep. of Germany

[21] Appl. No.: 214,252

[22] Filed: Dec. 8, 1980

[30] Foreign Application Priority Data

Feb. 21, 1980 [DE] Fed. Rep. of Germany ..... 3006569

[51] Int. Cl.[3] ..... C25D 5/00; C25D 5/02; B21K 11/02

[52] U.S. Cl. ..... 204/15; 76/104 R; 204/38 R

[58] Field of Search ..... 204/15, 38 R, 38 E; 76/104 R, 105, 106; 30/342, 340

[56] References Cited

U.S. PATENT DOCUMENTS

| | | | |
|---|---|---|---|
| 1,526,644 | 2/1925 | Pinney | 204/15 |
| 2,165,991 | 7/1939 | West | 76/106 |
| 3,481,038 | 12/1969 | Cooper | 76/104 R |

*Primary Examiner*—T. M. Tufariello

*Attorney, Agent, or Firm*—Finnegan, Henderson, Farabow, Garrett & Dunner

[57] ABSTRACT

A process for partially silver electroplating the metal surface of a flat silver part wherein part of the surface is covered prior to silvering with a plating-resistant dipping enamel. A separation surface is provided between the exposed surface of the part to be covered with the dipping enamel and the exposed surface of the lengthwise adjacent part to be silvered. The separation surface consists of a material which is more difficult to wet with the dipping enamel than the metal of the surface to be covered. Preferably, the separation surface is the peripheral surface of a spacer lamination composed of polytetrafluoroethylene.

8 Claims, 3 Drawing Figures

PROCESS FOR PARTIALLY ELECTROPLATING FLAT SILVER

The invention relates to a process for partially silver electroplating flat silver parts such as the handle of a table knife.

It is difficult to achieve a precise, optically flawless boundary when partially silver electroplating flat silver parts. As used herein, the term "flat silver" refers to forks, spoons and knives.

In the manufacture of table knives with silvered handles, for example, once the blade has been set into the handle, the transition site must be ground flush, that is, the so-called blade crop must be ground back as far as the contour of the blade. The procedure generally used involves silvering the handle, inserting the blade, and grinding flush the transition site, thus providing for an optimal boundary of the silvered surface. The flush-grinding step, however, is very costly since it can only be done by hand and requires a highly skilled workman. Further, since the silver layer of the handle must not be damaged, a slight step, wherein food residues may catch, remains at the blade crop even under the most favorable circumstances.

Moreover, complete silvering of an assembled and ground knife, wherein the silver coating must be mechanically removed from the blade, has also been found to be unsuitable since this method is only effective with soft silver that will not adhere to the steel of the blade. When hard silver is employed, the silver coating, owing to the underlayer of nickel contained in the hard silver, adheres so firmly to the steel blade that it cannot be removed.

There have thus been many attempts to join two components of a flat silver part, such as the handle and the blade, prior to silvering, to grind the transition site until no step is left, and to avoid contact of the blade with the silver during the subsequent silvering process.

German patent application No. P 28 29 776.9 describes a process in which the blade is electrically insulated with respect to the handle and makes contact with the handle only through the cathode in the electroplating process. Certain difficulties inherent in this process have continued to prevent this method from becoming practical.

The application of well-known electroplating technology, relating to enameling, to a process for partially silvering flat silver, such as the handles of table knives, has previously failed. Specifically, when the blade is dipped into the liquid enamel, a precise boundary of the enameling cannot be obtained at the gap between the handle and the crop because (1) it is extremely difficult in mass production to dip parts down to within a fraction of a millimeter of a specific mark; and (2) it is nearly impossible to maintain the constant physical parameters required to wet uniformly the blade surface with the dipping enamel.

For example, when a blade is dipped into a bath, the enamel initially pulls back slightly from the area of contact. If the blade remains motionless, however, the enamel rises toward the blade and forms a characteristic wall angle corresponding to the interface tension between the blade material and the dip enamel, which interface tension depends on the surface tensions of the materials involved.

It has been found experimentally that the wall angle forming between the blade material and the enamel cannot be predicted with sufficient accuracy. Specifically, because of the variable surface tension of the material to be wetted, the wall angle varies across the surface of a single part, i.e., for an absolute constant level of the dip enamel bath, the enamel boundary may be more or less serrated and may not everywhere reach the gap between blade crop and handle.

Thus, any impurity on the blade surface, whether sweat traces from finger prints or fatty residues from abrasives, can so alter the local surface tension that the same enamel will wet one blade but not the next and will in fact wet differently across the same blade. Accordingly, since the wall angle and hence the dip depth of a part to be coated cannot be predetermined with the required accuracy, the enamel coating therefore (1) may not extend to the mark, i.e., the gap between the blade and the handle; (2) it may extend beyond the mark; or (3) both defects may simultaneously be present.

It is the object of the present invention to create a process for the partial silvering of flat silver, wherein a precise boundary between the silvering and the surface not to be silvered will be achieved and wherein the silvering, especially during the manufacture of table knives, can be carried out on the assembled and ground workpiece.

The object of the present invention is achieved by providing a separation surface between the surface of the component to be covered with dipping enamel and the surface of the component to be silvered. This separation surface is wetted poorly or not at all by the dip enamel. The unpredictable wetting behavior of the dip enamel is thus buffered, so that variations in both interface tensions and, to some extent, dipping depths can be neutralized.

Thus, the dipping apparatus no longer needs such precise adjustment as heretofore. Moreover, operating personnel who dip manually no longer need control their motions so sharply.

When manufacturing table knives and other flat silver assembled from several pieces wherein the silvering must terminate precisely at the transition site from one piece to the next, it is particularly advantageous that the separation surface be the peripheral surface of a spacer lamination inserted between the parts to be joined, such as between the crop of the blade and the handle.

The separation surface preferably consists of polytetrafluoroethylene. Surprisingly, it was found that when using this material, a separation surface thickness of at least 0.1 mm, preferably 0.2 mm, suffices to retain the desired properties.

The concept of the invention is described below in further detail in relation to the drawings.

Figure 1:
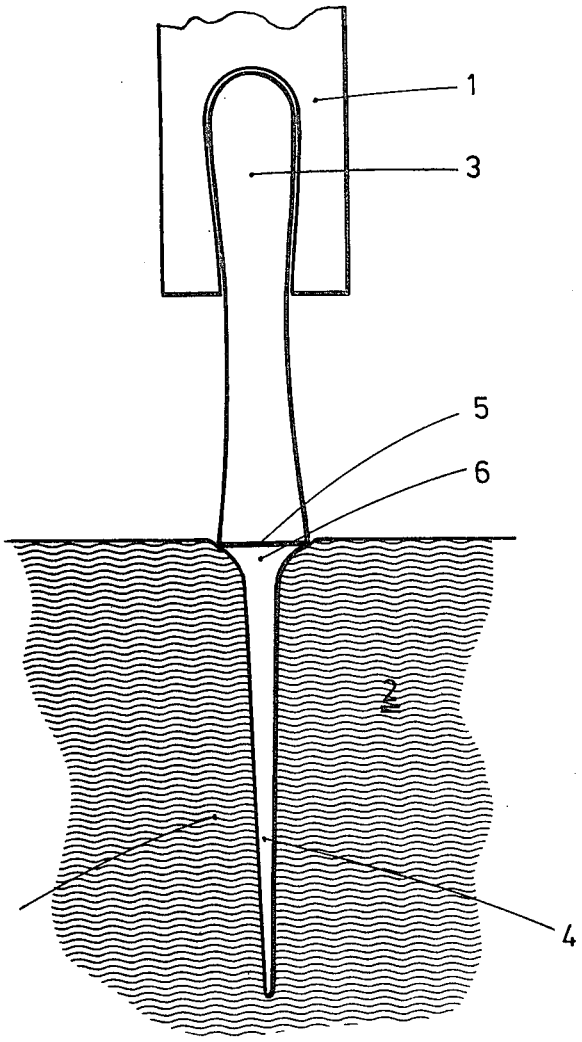
FIG. 1 shows a knife being dipped into a dip enamel.

FIG. 1 shows a dipping system with a schematic clamping head 1 and a dip enamel bath 2 for a knife consisting of a handle 3 and a blade 4. When assembling the blade 4 and the handle 3, either by "soldering", by gluing with synthetics or by cementing, a somewhat protruding spacer lamination 5 is inserted between the blade 4 and the handle 3. The blade 4 and the handle 3 are compressed hard while the bonding materials harden; thus the spacing lamination 5 additionally becomes a seal for the gap. After the bonding materials are hardened, the knife is ground flush, in which process the spacing lamination is leveled to the surface of the knife handle.

Figure 2:
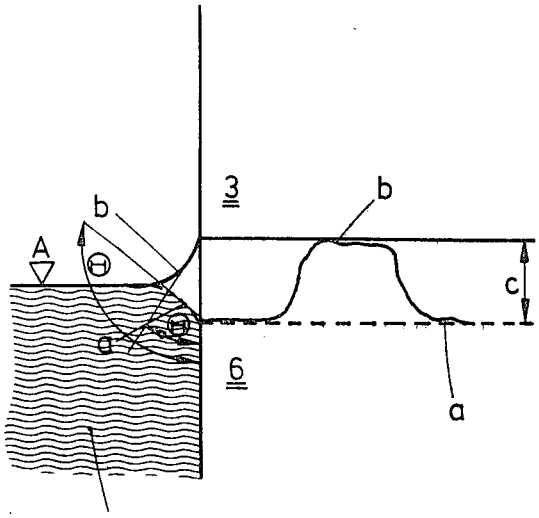
FIG. 2 is an enlarged representation of the termination of the dip enamel in the absence of a separation surface.

In the case of the knife without a spacer lamination, the meniscus shown in FIG. 2 with a wall angle $\theta$ less than 90° will be formed shortly after the blade 4 is dipped a little below the transition site of the handle 3 into the dip enamel 2. As already mentioned, this angle depends on the ratio of the surface tension of the dip enamel 2 to that of the blade 4.

A wall angle $\theta<90°$, as is the case under discussion, means that the surface tension of the material to be covered is large compared to that of the dip enamel and that the blade surface will be wetted. Impurities may so decrease the surface tension of the blade that the wall angle $\theta$ becomes larger than the 90° and the surface of the dipping bath will be as shown in curve a. The boundary of the enamel will then vary within the limits c in spite of the constant level A of the dipping bath.

Figure 3:
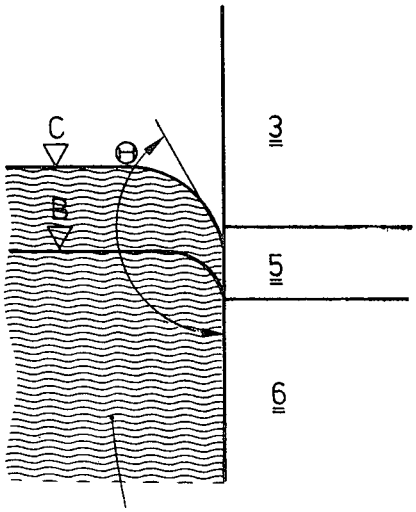
FIG. 3 is an enlarged representation of the termination of the dip enamel in the presence of a separation surface.

As shown in FIG. 3, when a knife with a separation surface such as spacer lamination 5 is immersed into the dipping bath 2 as far as the transition site from blade 4 to the handle 3, then the spacing lamination 5 prevents, even after dwell time, the formation of a meniscus, as $\theta$ exceeds 90° for non-wetting surfaces. The blade 4 accordingly can be dipped as far as the spacing lamination 5 into the dipping bath without the dipping enamel rising in an unforeseeable manner at the surface. This "braking effect" will tolerate a short-term deeper dipping within the limits of levels B and C into the dipping enamel. Thus, the dipping apparatus no longer need be controlled as precisely, i.e., if there is manual dipping, the operating personnel need not control their motions so sharply.

In addition to possessing the property of low wetting, the material used for the spacer lamination 5, particularly when manufacturing table knives, must be mechanically very stable, resistant to all sorts of food and cleansing means, resistant to temperature effects up to about 200° C. and yet effective even when the lamination is quite thin.

A particularly preferred material is polytetrafluoroethylene. In practical tests with teflon laminated spacers, it was found that a lamination of only 0.2 mm gives optimal results. Such a thin spacing lamination is hardly visible in the finished knife and thus in no way affects the overall aesthetic appearance.

Use of an interposed spacer lamination is not essential for achieving the object of the present invention. The boundary area also may consist of a strip of material deposited on the surface or inserted into an existing groove. Further, when a workpiece is exposed to reduced thermal, chemical or mechanical stresses, a more economical material than polytetrafluroethylene, but possessing the same wetting properties, may also be used.

What is claimed is:

1. a process for partially silver electroplating a flat silver part, the part including two metal components to be joined lengthwise, the first component to be covered with a plating-resistant dipping enamel and the second component to be electroplated with silver, the process comprising the steps of:

(a) joining lengthwise the said two metal components;

(b) providing a thin separation surface between exposed surfaces of said two components, said separation surface consisting of a material which is more difficult to wet with the dipping enamel than the metal of the first component to be covered;

(c) dipping said first component into said enamel until contact is achieved between said enamel and said separation surface; and (d) silver electroplating said second component.

2. The process of claim 1, including, immediately prior to said dipping, the further step of grinding the transition site of said two joined components.

3. The process of claim 1, wherein said two components are joined lengthwise to a spacer lamination, said spacer lamination separating exposed surfaces of said first and second components and further wherein the peripheral surface of said spacer lamination provides said separation surface.

4. The process of claim 3 wherein said flat silver part is a table knife, said first metal component is a blade having a crop thereof, said second metal component is a handle and said spacer lamination separates the crop of said blade from said handle.

5. The process of claim 3, wherein said spacer lamination has a thickness of at least about 0.1 mm.

6. The process of claim 5 wherein said spacer lamination has a thickness of about 0.2 mm.

7. The process of claim 1, wherein said separation surface is made of polytetrafluoroethylene.

8. In a process for partially silver electroplating the metal surface of a flat silver part wherein, prior to silvering a lengthwise adjacent part of the surface, a part of the surface is covered with a plating-resistant dipping enamel, the improvement comprising the step of:

providing a separation surface between an exposed surface of said part to be covered with the dipping enamel and an exposed surface of said lengthwise adjacent part to be silvered, said separation surface consisting of a material which is more difficult to wet with the dipping enamel than the metal of the surface to be covered.

* * * * *